US011417462B2

(12) United States Patent
Degner et al.

(10) Patent No.: US 11,417,462 B2
(45) Date of Patent: Aug. 16, 2022

(54) ONE-STEP PROCESSING OF MAGNET ARRAYS

(71) Applicant: FORD GLOBAL TECHNOLOGIES, LLC, Dearborn, MI (US)

(72) Inventors: Michael W. Degner, Novi, MI (US); Wanfeng Li, Novi, MI (US); Franco Leonardi, Dearborn Heights, MI (US)

(73) Assignee: Ford Global Technologies LLC, Dearborn, MI (US)

( * ) Notice: Subject to any disclaimer, the term of this patent is extended or adjusted under 35 U.S.C. 154(b) by 420 days.

(21) Appl. No.: 16/414,862

(22) Filed: May 17, 2019

(65) Prior Publication Data

US 2020/0365318 A1 Nov. 19, 2020

(51) Int. Cl.

| | |
|---|---|
| ***H01F 41/02*** | (2006.01) |
| ***H01F 1/057*** | (2006.01) |
| ***H01F 7/02*** | (2006.01) |
| ***H01F 1/14*** | (2006.01) |
| ***H01F 7/20*** | (2006.01) |

(52) U.S. Cl.

CPC ..... *H01F 41/0253* (2013.01); *H01F 1/057* (2013.01); *H01F 1/14* (2013.01); *H01F 7/02* (2013.01); *H01F 7/20* (2013.01); *H01F 41/0206* (2013.01)

(58) Field of Classification Search

None

See application file for complete search history.

(56) References Cited

U.S. PATENT DOCUMENTS

| | | | | |
|---|---|---|---|---|
| 4,747,874 | A | 5/1988 | Ghandehari | |
| 5,225,005 | A | 7/1993 | Burrage et al. | |
| 9,082,546 | B2 * | 7/2015 | Komura | H01F 1/40 |
| 2002/0182557 | A1 * | 12/2002 | Kuriyama | H05B 6/22 432/124 |
| 2016/0035487 | A1 | 2/2016 | Kim et al. | |
| 2018/0108464 | A1 | 4/2018 | Fujikawa et al. | |
| 2018/0226190 | A1 | 8/2018 | Meinke et al. | |

* cited by examiner

*Primary Examiner* — Xiaowei Su

(74) *Attorney, Agent, or Firm* — David B. Kelley; Brooks Kushman P.C.

(57) ABSTRACT

A method of forming an annealed magnet includes positioning a magnetizing array ring concentrically with a ring of bulk magnetic material to form an assembly, the magnetizing array ring having a magnetic field defining directions for orienting grains of the ring of bulk magnetic material, placing the assembly in a furnace, and operating the furnace to anneal the ring of bulk magnetic material and grow the grains in the directions. A magnetic array assembly includes a furnace; and an assembly including (i) a ring of bulk magnetic material having grains and (ii) a magnetizing array ring concentric with the ring of bulk magnetic material, and having a magnetic field defining directions for orienting the grains during growth thereof in a presence of heat from the furnace.

19 Claims, 3 Drawing Sheets

ONE-STEP PROCESSING OF MAGNET ARRAYS

TECHNICAL FIELD

The present disclosure is related to structures related to and fabrication of permanent magnets, and more particularly, magnetic arrays.

BACKGROUND

The importance of permanent magnets has been increasing in energy conversion devices. While efforts have been conventionally focused on high performance permanent magnets with less dependence on rare and critical materials, some research and development has also focused on improving the magnetic circuit to more efficiently use the magnets.

Conventionally, materials with high permeability, such as electrical steels, are combined with permanent magnet material to modulate the magnitude and distribution of magnetic flux. Alternatively, magnetic fields and their distribution can be modified by changing the permanent magnet shape, size, or arrangement, for example. By arranging permanent magnet pieces with different shapes and magnetization orientations, a magnetic field of varying magnitude and orientation can be produced. A common application of this type is a Halbach array. Although Halbach arrays are conventionally designed for charged particle beam guides, they can also be used in other applications, such as electric machines. For electric machines, strong magnetic fields can be generated with Halbach arrays without using electrical steel, which makes the resulting machine lighter and more efficient. Furthermore, the magnetic field generated by the Halbach arrays is more sinusoidal, resulting in a controlled structure with a reduced torque ripple. Besides Halbach arrays, there are also other conventional magnet arrays, which can be used independently to generate strong magnetic fields, or can be combined with other designs for magnetic devices, providing better performance or more design flexibility.

Despite the advancement of conventional permanent magnet arrays, manufacturing of these designs remains challenging, or expensive, or both because the desired flux distribution requires the magnetization direction to gradually vary in different portions of the arrays. Conventional bulk permanent magnets are prepared with unidirectional orientation. The magnet arrays are made by cutting magnets into smaller pieces, often with irregular shapes, and assembling the cut pieces into the desired array. The complex processing steps for arranging and the waste of material due to cutting may increase the cost and complexity of using such arrays.

SUMMARY

According to at least one embodiment, a method of forming an annealed magnet includes positioning a magnetizing array ring concentrically with a ring of bulk magnetic material to form an assembly, the magnetizing array ring having a magnetic field defining directions for orienting grains of the ring of bulk magnetic material, placing the assembly in a furnace, and operating the furnace to anneal the ring of bulk magnetic material and grow the grains in the directions.

According to one or more embodiments, the magnetizing array ring may be positioned radially inward of the ring of bulk magnetic material. In at least one embodiment, the method may further include positioning a second magnetizing array ring radially outward of the ring of bulk magnetic material to form the assembly such that the second magnetizing array ring cooperates with the magnetizing array ring to adjust the directions. In certain embodiments, the second magnetizing array ring may increase a flux density at selective portions of the ring of bulk magnetic material to modify grain alignment. In certain embodiments, at least one of the magnetizing array rings may be a permanent magnet material. In some embodiments, one of the magnetizing array rings may be a soft magnetic material. In one or more embodiments, the method may further include forming the ring of bulk magnetic material from an MnBi alloy material. In some embodiments, the bulk magnetic material may further include Ti, Zr, Nb, or Ta, or combinations thereof.

According to at least one embodiment, a method of forming an annealed magnet includes positioning a magnetizing array ring concentrically with a ring of bulk magnetic material to form an assembly, the magnetizing array ring having a magnetic field defining directions for orienting grains of the ring of bulk magnetic material, placing the assembly in a furnace, operating the furnace at a first temperature for a first duration to begin annealing the ring of bulk magnetic material and growing the grains in the directions, and operating the furnace at a second temperature, greater than the first, for a second duration to continue annealing the ring of bulk magnetic material and grow the grains in the directions.

According to one or more embodiments, the magnetizing array ring may be positioned radially inward of the ring of bulk magnetic material. Further, in at least one embodiment, the method may further include positioning a second magnetizing array ring radially outward of the ring of bulk magnetic material to form the assembly such that the second magnetizing array ring cooperates with the magnetizing array ring to adjust the directions. In certain embodiments, the second magnetizing array ring may increase a flux density at selective portions of the ring of bulk magnetic material to modify grain alignment.

According to at least one embodiment, a magnetic array assembly includes a furnace; and an assembly disposed within the furnace including (i) a ring of bulk magnetic material having grains and (ii) a magnetizing array ring concentric with the ring of bulk magnetic material, and having a magnetic field defining directions for orienting the grains during growth thereof in a presence of heat from the furnace.

According to one or more embodiments, the magnetizing array ring may be positioned radially inward of the ring of bulk magnetic material. In at least one embodiment, the assembly may include second magnetizing array ring positioned concentric with and radially outward of the ring of bulk magnetic material, the second magnetizing array ring cooperating with the magnetizing array ring to adjust the directions and increase a flux density at selective portions of the ring of bulk magnetic material to modify grain alignment. In certain embodiments, the magnetizing array ring, the second magnetizing array ring, or both may have a circumferentially varying radial thickness or height to adjust the directions. In one or more embodiments, at least one of the magnetizing array rings may be a permanent magnet material. Further, in some embodiments, one of the magnetizing array rings may be a soft magnetic material. In at least one embodiment, the bulk magnetic material may be MnBi. According to one or more embodiments, the bulk magnetic material may include Ti, Zr, Nb, or Ta, or combinations thereof

DETAILED DESCRIPTION

Figure 1:
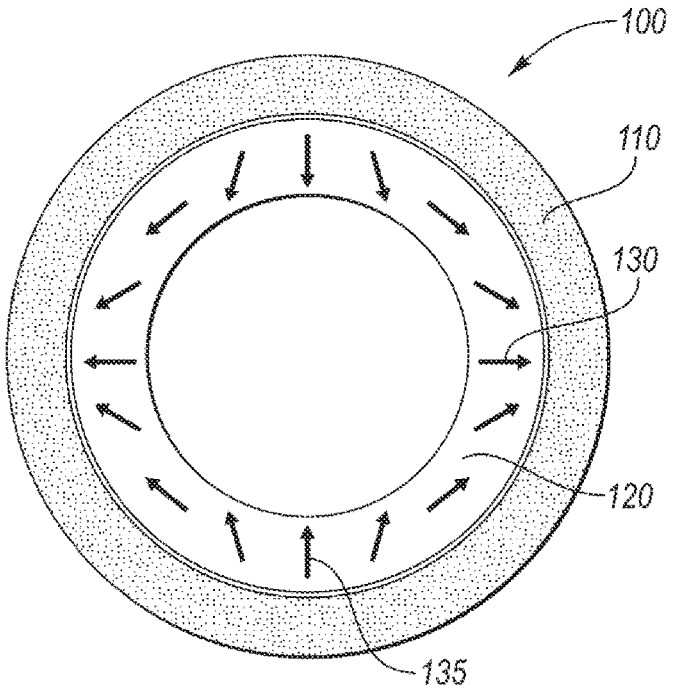
FIG. 1 is a schematic diagram of a magnetizing assembly according to an embodiment.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Moreover, except where otherwise expressly indicated, all numerical quantities in this disclosure are to be understood as modified by the word "about" in describing the broader scope of this disclosure. Practice within the numerical limits stated is generally preferred. Also, unless expressly stated to the contrary, the description of a group or class of materials by suitable or preferred for a given purpose in connection with the disclosure implies that mixtures of any two or more members of the group or class may be equally suitable or preferred.

Except in any examples, or where otherwise expressly indicated, all numerical quantities in this description indicating amounts of material or conditions of reaction and/or use are to be understood as modified by the word "about" in describing the broadest scope of the invention. Practice within the numerical limits stated is generally preferred. Also, unless expressly stated to the contrary: percent, "parts of," and ratio values are by weight; the description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description, and does not necessarily preclude chemical interactions among the constituents of a mixture once mixed; the first definition of an acronym or other abbreviation applies to all subsequent uses herein of the same abbreviation and applies mutatis mutandis to normal grammatical variations of the initially defined abbreviation; and, unless expressly stated to the contrary, measurement of a property is determined by the same technique as previously or later referenced for the same property.

It is also to be understood that this invention is not limited to the specific embodiments and methods described below, as specific components and/or conditions may, of course, vary. Furthermore, the terminology used herein is used only for the purpose of describing particular embodiments of the present invention and is not intended to be limiting in any way.

It must also be noted that, as used in the specification and the appended claims, the singular form "a," "an," and "the" comprise plural referents unless the context clearly indicates otherwise. For example, reference to a component in the singular is intended to comprise a plurality of components.

According to at least one embodiment, a magnetic array assembly includes at least one magnetizing ring generating a magnetic field to grow the grains in the magnet ring and guide the magnetization direction during annealing of the permanent magnet ring. Thus, the annealed magnet forms a new magnet array in a single step. For some permanent magnets, such as, for example, MnBi, and Al—Ni—Co, the magnetic phases are formed by an annealing process. The formation temperature, or the phase transition temperature must be below the Curie temperature of the permanent magnetic phase. By applying a magnetic field during annealing, the grains can be selectively grown and aligned such that the magnetic easy axes of the grains are oriented the same direction as the magnetic field. The magnetization direction of the grains can be varied gradually with how the magnetic field of the magnetizing rings are positioned relative to the magnet ring. Performance may be optimized by preprocessing the magnetizing array, for example by varying the geometry of the magnetizing array, to orient the magnetic field distribution and flux density for the desired grain alignment.

Referring to FIG. 1, a magnetic array 100, or magnetic array assembly 100, is shown according an embodiment. The magnetic array 100 includes a magnet ring 110 having unaligned grains to be grown during annealing or unaligned grains to be formed and grown during annealing. Magnet ring 110 is the magnet to be annealed under the magnetic field of the magnetic array 100, such that the grains grow and are aligned by the array 100. Magnet ring 110 may be, in some embodiments, a permanent magnet material, such as, but not limited to a rare earth free permanent magnet. In some embodiments, magnet ring 110 may be an MnBi magnet. In some embodiments, the magnet ring 110 may include metallic elements such as, but not limited to, Ti, Zr, Nb, Ta, or combinations thereof, to decrease the grain size to achieve higher coercivity in the annealed magnet. The metallic elements can be added into the raw Mn—Bi alloy to form precipitates to limit grain growth during annealing. Alternatively, ceramic nanoparticles can be mixed with the Mn—Bi powders before pressing and annealing for the same purpose.

Magnetic array 100 further includes at least one magnetizing array ring 120 for generating a magnetic field. The magnetizing array ring 120 may include a permanent magnet material, such as, but not limited to Nd—Fe—B, Sm—Co, and Sm—Fe—N. The magnetizing array ring 120 may be selected according to the annealing temperature and cooling process for the magnet ring 110. As shown FIG. 1, a magnetizing array ring 120 is positioned concentric with the magnet ring 110. Although the magnetizing array ring 120 shown in FIG. 1 is radially inward of the magnet ring 110, the magnetizing array ring 120 may be disposed radially outward of the magnet ring 110 in an alternative embodiment, and FIG. 1 is not intended to be limiting. Magnetizing array ring 120 generates the magnetic field includes varying magnetization directions 130, 135 around the circumference of the magnetizing array ring 120. Because of the varied magnetization direction, the grains are grown and aligned in the magnet ring 110 during annealing according to the various magnetization directions 130, 135 of the magnetizing array ring 120. As such, the magnetic field generated by the magnetizing array ring 120 guides orientation of the grains inside the magnet ring 110 being annealed, and forms the resulting annealed and aligned magnet in one step.

Figure 2:
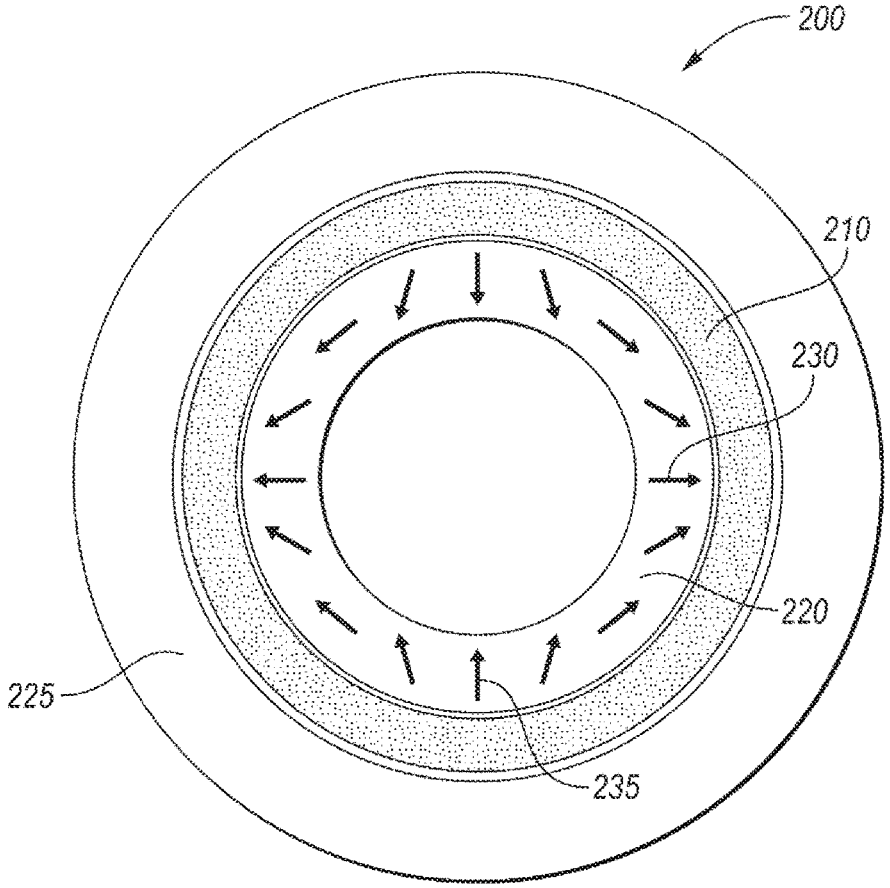
FIG. 2 is a schematic diagram of a magnetizing assembly according to another embodiment.

Referring to FIG. 2, magnetic array assembly 200 is shown according to another embodiment. The magnetic array assembly 200 includes a magnet ring 210 having unaligned grains to be grown during annealing or unaligned grains to be formed and grown during annealing. Magnet ring 210 is the magnet to be annealed under the magnetic field of the magnetic array assembly 200, such that the grains grow and are aligned by the assembly 200. Magnet ring 210 may be, in some embodiments, a permanent magnet material, such as, but not limited to a rare earth free permanent magnet. In some embodiments, magnet ring 210 may be an MnBi magnet. In some embodiments, the magnet ring 210 may include metallic elements such as, but not limited to, Ti, Zr, Nb, Ta, or combinations thereof, to decrease the grain size to achieve higher coercivity in the annealed magnet. The metallic elements can be added into the raw Mn—Bi alloy to form precipitates to limit grain growth during annealing. Alternatively, ceramic nanoparticles can be mixed with the Mn—Bi powders before pressing and annealing for the same purpose.

Magnetic array assembly 200 further includes magnetizing array ring 220 and magnetizing array ring 225 for generating respective magnetic fields with respective magnetization directions, thus cooperating to generate a magnetic field with a desired grain magnetization for the magnet ring 210. As shown FIG. 2, a first magnetizing array ring 220 is positioned concentric with the magnet ring 210 radially inward of the magnet ring 210. Magnetic array assembly 200 further includes a second magnetizing array ring 225 positioned concentric with the magnet ring 210 and radially outward of the magnet ring 210. Magnetizing array ring 220 generates the magnetic field includes varying magnetization directions 230, 235 around the circumference of the magnetizing array ring 220. Similarly, magnetizing array ring 225 enhances the field intensity and further modulates the magnetic field directions generated by magnetizing array ring 220. The combination of the magnetizing array rings 220, 225 (and their magnetization directions) generates varied flux orientation and density in a circumferential direction on the magnet ring 210. In some embodiments, selective portions of the magnet ring 210 can have increased flux density. Because of the magnetic field generated by the array assembly 200, grains of magnet ring 210 are formed and/or grown and aligned during annealing according to the various magnetization directions of the magnetizing array rings 220, 225. The second magnetizing array ring 225 enhances the magnetic field generated by the magnetizing array ring 220 and modulates the orientation and distribution of the magnetic field at the magnet ring 210. As such, the magnetic field generated by the array assembly 200 guides orientation of the grains as they grow inside the magnet ring 210 during annealing, and forms the resulting annealed and aligned magnet array in one step.

Referring again to FIG. 2, at least one of the magnetizing array rings 220, 225 include a permanent magnet material, such as, but not limited to, (material list from para [0019]). In certain embodiments, both magnetizing array rings 220, 225 are a permanent magnet material, however the magnetizing array rings 220, 225 may be mixtures of different permanent magnet materials. In other embodiments, one of the magnetizing array rings may be a soft magnetic material, or a mixture of different soft materials. In yet another embodiment, magnetizing array rings 220, 225 may be a mixture of soft and permanent magnet materials.

Figure 3:
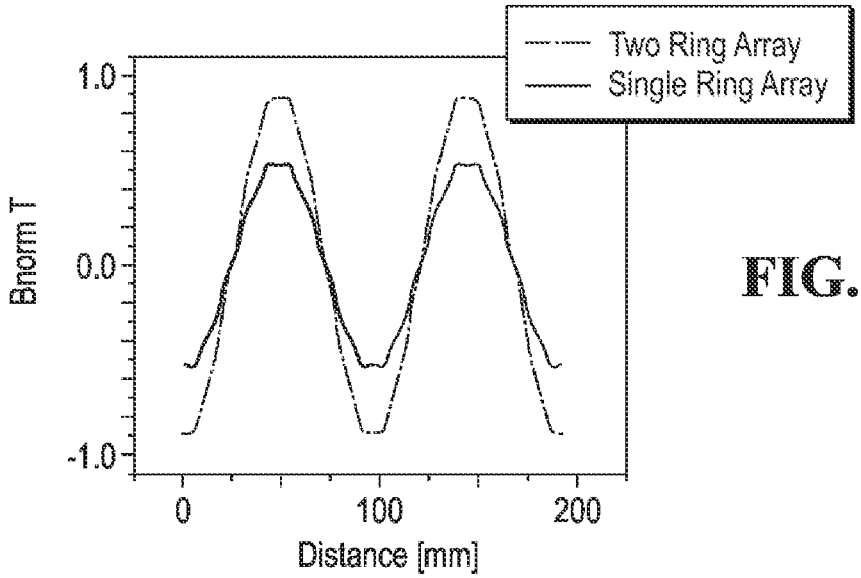
FIG. 3 is a graph showing the flux density generated by the magnetizing arrays of FIG. 1 and FIG. 2.

According to at least one embodiment, each of the magnetizing array rings may have a modified shape or dimension to generate a specific or desired magnetic field. For example, in some embodiments, the magnetizing array ring may be homogeneous electrical steel, but include a periodically varying thickness in the circumferential direction, or, in other embodiments, include patterns to modify the field between the magnetizing array rings and the magnet ring. As best illustrated in the embodiment shown in FIG. 2, by adding a second magnetizing array ring 225 to the assembly 200, the flux density and therefore the magnetic field intensity in the gap between the rings is significantly increased, as shown in FIG. 3. By incorporating a second magnetizing array ring, the flux density generated at the magnet ring is greater than the flux density generated by either magnetizing array ring individually. Specifically, FIG. 3 shows the enhancement to the flux density generated by the inner magnetizing array ring when a soft magnetizing array ring is added radially outward of the magnet ring to be annealed, as shown in FIG. 2. This enhancement in magnetizing the magnetic field improves the alignment of the grains in the magnet during annealing and increases the surface flux density of the magnet after annealing.

According to at least one embodiment, a method for forming a magnetic array for annealing a permanent magnet includes providing a permanent magnet material for forming a magnet ring. For example, a MnBi magnet ring is discussed hereafter, however any permanent magnet material may be annealed under appropriate conditions for the selected material under a magnetic field generated by the magnetizing array of the present disclosure. A MnBi rare earth free permanent magnet may be produced from raw materials, where the raw materials may be prepared by arc melting or other known techniques for bulk material preparation. In certain embodiments, a non-equilibrium step, such as gas atomization or melt spinning, may be performed to prepare the powders with an atomic ratio of Mn and Bi of about 1:1. The Mn and Bi bulk material generally include unaligned grains for growth during annealing. In some embodiments, the Mn—Bi alloy is amorphous, and in other embodiments, the Mn—Bi alloy may be nanocrystalline with a small amount of a magnetic MnBi phase formed. The magnet ring is then formed by cold or warm pressing the powders, ribbons, or flakes in a die. In embodiments where the ring is warm pressed, the pressing temperature may be lower than 280° C. for less than 10 minutes to avoid significant grain growth of the magnetic MnBi phase.

The magnet ring can then be placed into the magnetizing array assembly, as shown in FIG. 1 or 2, for annealing in the presence of a magnetic field in a furnace. In embodiments including an MnBi magnet ring, since the annealing temperature of MnBi is low, the magnetizing array ring(s) may be Nd—Fe—B and/or Sm—Co. In some embodiments, the annealing temperature can be as low as 150° C. Furthermore, with the MnBi magnet ring and permanent magnet magnetizing array ring(s), the magnetizing array rings and the MnBi ring can be placed in a furnace for heat treatment without any additional cooling requirement. During heat treatment, the magnetic ring MnBi phase grains are formed/grown and aligned along the magnetic field direction according to the magnetic field(s) generated by the magnetizing array ring(s). As such, an array similar to a Halbach array of MnBi can be prepared and magnetized in one step.

Figure 4:
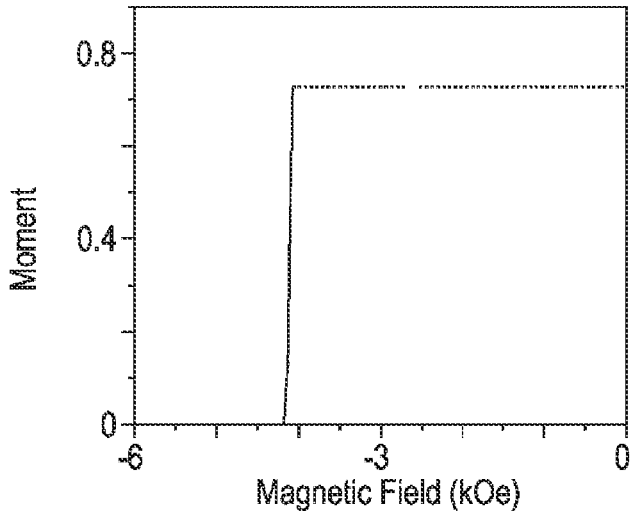
FIG. 4 is a graph showing the demagnetization curve of a magnet annealed in a uniform magnetic field.

Referring to FIG. 4, a demagnetization curve of a MnBi magnet after annealing at 340° C. in the presence of a magnetic field is shown. Although higher temperatures can accelerate the formation and grain growth of a ferromagnetic MnBi phase, due to the large grain size, the coercivity of the magnet may be low as illustrated in FIG. 4, where the MnBi magnet ring was annealed in homogeneous magnetic field at 340° C. The annealed magnet presents an improved texture as illustrated by the squareness of the demagnetization curve, however the coercivity requires improvement.

Figure 5:
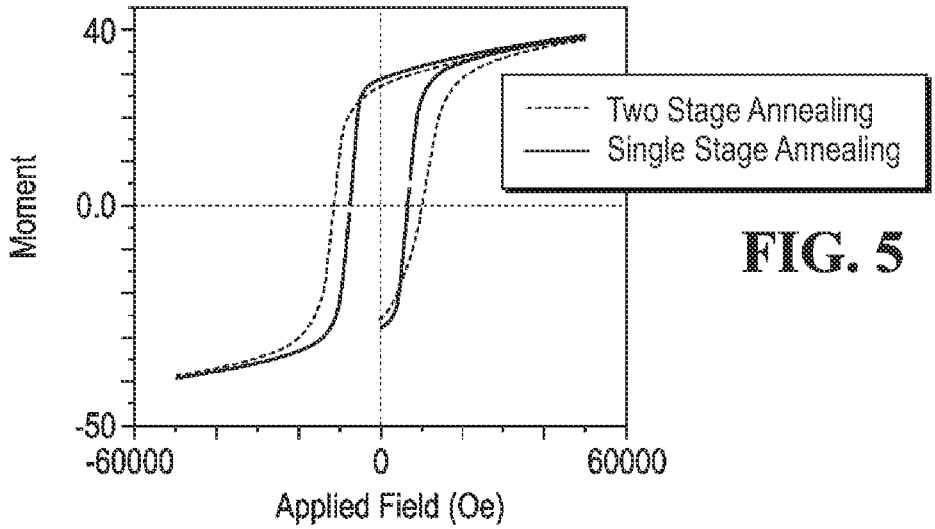
FIG. 5 is a graph showing the hysteresis loops of magnets under one stage and two stage magnetic field annealing according to an embodiment.

FIG. 5 illustrates the comparison between the properties of the annealed magnet after one stage (Sample B, shown as a solid line) and two stage (Sample A, shown as a dashed line) annealing (i.e., operating the furnace at a first temperature, and then a second temperature) such that coercivity can be improved. By decreasing the annealing temperature the coercivity can be gradually increased. However, by slowing the phase transition, a longer annealing time is needed to achieve the same remanence of the magnet. Alternatively, the magnet can be annealed in two stages, i.e. the magnet ring is first annealed at lower temperature, for example, 240° C., and then the temperature is increased to a second temperature, for example to 300° C. for a second stage annealing. The two-stage method helps achieve higher remanence within a shorter time, and also avoids detrimental impact of the processing on coercivity. According to other embodiments, additional stages can be added to provide the gradual increase in coercivity. By annealing the magnet ring first at lower temperature, the coercivity can be significantly increased, as shown by Sample A.

Furthermore, as previously discussed, the magnet bulk material may include metallic elements to decrease the grain size for higher coercivity. The metallic elements may be Ti, Zr, Nb, or Ta, or combinations thereof. The metallic elements can be added into the raw alloy to form precipitates which prevent excessive grain growth during annealing. Alternatively, ceramic nanoparticles can be mixed with the Mn—Bi powders before pressing and annealing for the same purpose.

Figure 6A:
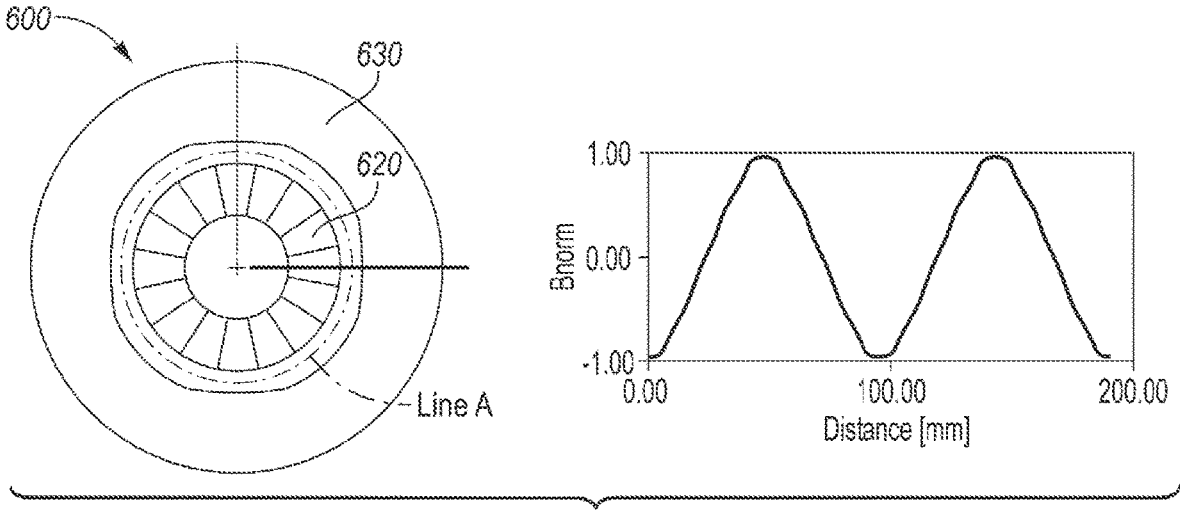
FIGS. 6A-C are schematic diagrams of magnetizing arrays and graphs showing the respective flux densities of various embodiments.
Figure 6B:
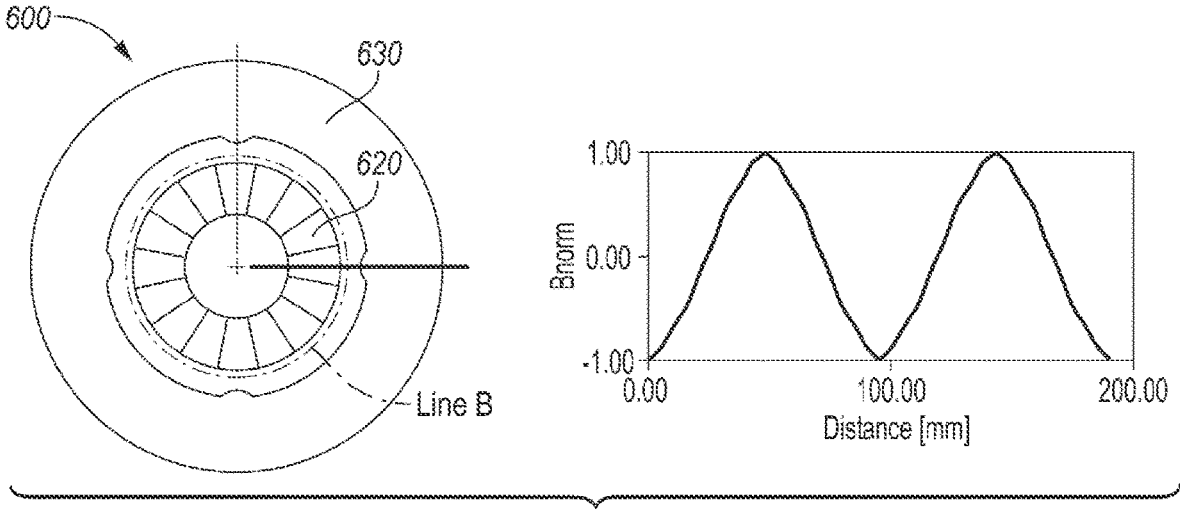
Figure 6C:
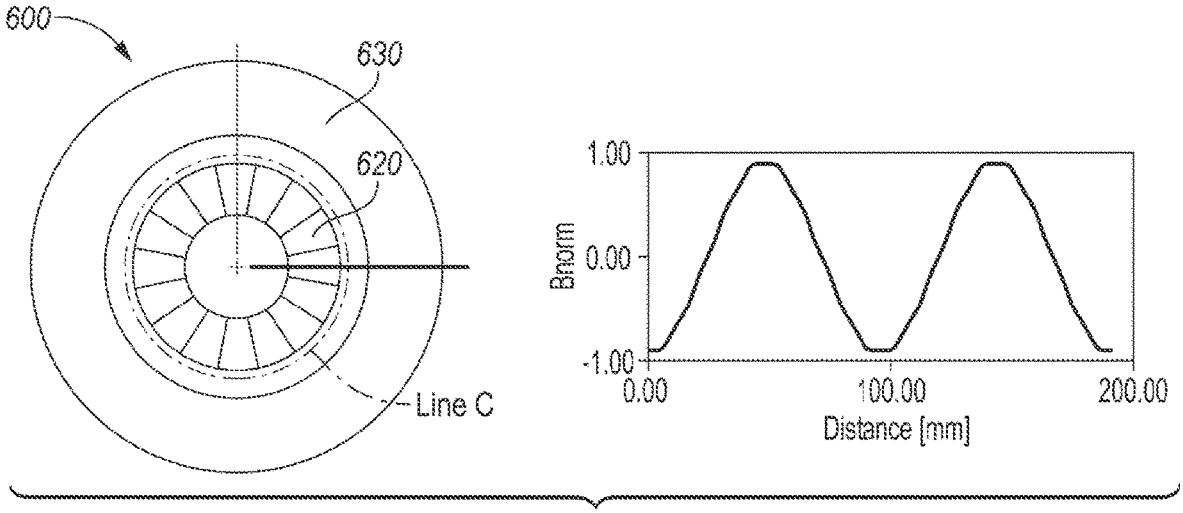

Referring FIGS. 6A-C, various exemplary embodiments of magnetic arrays 600 are shown. The arrays 600 of FIGS. 6A-C include Lines A-C, respectively, where the magnet ring material would be annealed between magnetizing array rings 620, 630. The graphs of flux density at Lines A-C are shown to the right of FIGS. 6A-C, respectively. As discussed above, in certain embodiments, the shape and dimension of the magnetizing array rings 620, 630 of magnetic arrays 600 may be modified to generate the desired magnetic field. The adjustment of the ring geometry, such as the patterns, thickness, or width, enhances and also modulates the orientation and distribution of the magnetic field because of the varying flux density of the magnetic field in each magnetization direction. In some embodiments, the magnetizing array rings may have a varying radial thickness or height in the circumferential direction. In other embodiments, the magnetizing array rings may include protrusions or indentations in the circumferential direction to vary the magnetization direction of the generated magnetic field. Similarly, adjustments to the shape and dimension of the magnetizing array ring will adjust and/or enhance the flux density and can tailor the magnetization direction specifically. This enhancement in magnetizing magnetic field can improve the alignment of the grains in the magnet during annealing and increase the surface flux density of the magnet after annealing.

According to at least one embodiment, a magnetic array for preparing an annealed permanent magnet in one step includes a magnet ring and at least one magnetizing array ring configured to generate a magnetic field with the desired magnetization directions. The magnetic array can be annealed to grow the grains while the magnetic field orients the grains in the magnet ring according to the desired magnetization direction. Additional magnetizing array rings can be incorporated to adjust or enhance the magnetic field at selected areas of the magnet ring, thus improving the flux density of the magnetic field. At least one magnetizing array ring may be a permanent magnet material, however additional magnetizing array rings may be a soft magnetic material, a permanent magnet material, or combinations thereof. Furthermore, the specific magnetization direction can be controlled by varying the geometry and dimensions of the magnetizing array ring(s). By annealing the magnetic powder, such as MnBi or other alloys with similar characteristics, in a magnetic field formed by magnetizing array rings, a magnetic array assembly can be prepared. Compared with the conventional method of cutting and assembling permanent magnet segments, a less costly and more efficient process can be achieved, while allowing for particular orientation distribution inside the array via design modification the magnetizing fixture.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A method of forming an annealed magnet comprising:

positioning a magnetizing array ring concentrically with and radially inward of a ring of bulk magnetic material to form an assembly, the magnetizing array ring having an annular structure of magnetizing material generating a continuous magnetic field about the annular structure defining directions for orienting grains of the ring of bulk magnetic material;

placing the assembly in a furnace; and operating the furnace to anneal the ring of bulk magnetic material and grow the grains in the directions.

2. The method of claim 1, further comprising positioning a second magnetizing array ring radially outward of the ring of bulk magnetic material to form the assembly, wherein the second magnetizing array ring cooperates with the magnetizing array ring to adjust the directions.

3. The method of claim 2, wherein the second magnetizing array ring increases a flux density at selective portions of the ring of bulk magnetic material to modify grain alignment.

4. The method of claim 2, wherein at least one of the magnetizing array rings is a permanent magnet material.

5. The method of claim 4, wherein one of the magnetizing array rings is a soft magnetic material.

6. The method of claim 2, wherein the magnetizing array ring, the second magnetizing array ring, or both have a circumferentially varying radial thickness or height to adjust the directions.

7. The method of claim 1, further comprising forming the ring of bulk magnetic material from an MnBi alloy material.

8. The method of claim 7, wherein the bulk magnetic material further includes Ti, Zr, Nb, or Ta, or combinations thereof.

9. A method of forming an annealed magnet comprising:

positioning a magnetizing array ring concentrically with and radially inward of a ring of bulk magnetic material to form an assembly, the magnetizing array ring having an annular structure of magnetizing material generating a continuous magnetic field about the annular structure defining directions for orienting grains of the ring of bulk magnetic material;

placing the assembly in a furnace;

operating the furnace at a first temperature for a first duration to begin annealing the ring of bulk magnetic material and growing the grains in the directions; and operating the furnace at a second temperature, greater than the first, for a second duration to continue annealing the ring of bulk magnetic material and growing the grains in the directions.

10. The method of claim 9, further comprising positioning a second magnetizing array ring radially outward of the ring of bulk magnetic material to form the assembly, wherein the second magnetizing array ring cooperates with the magnetizing array ring to adjust the directions.

11. The method of claim 10, wherein the second magnetizing array ring increases a flux density at selective portions of the ring of bulk magnetic material to modify grain alignment.

12. The method of claim 10, wherein the magnetizing array ring, the second magnetizing array ring, or both have a circumferentially varying radial thickness or height to adjust the directions.

13. A magnetic array assembly comprising:

a furnace; and an assembly disposed within the furnace and including (i) a ring of bulk magnetic material having grains; (ii) a first magnetizing array ring concentric with the ring of bulk magnetic material and positioned radially inward of the ring of bulk magnetic material, the first magnetizing array ring having an annular structure of magnetizing material generating a continuous magnetic field about the annular structure defining directions for orienting the grains during growth thereof in a presence of heat from the furnace.

14. The magnetic array assembly of claim 13, wherein the assembly includes a second magnetizing array ring having another annular structure of magnetizing material positioned concentric with and radially outward of the ring of bulk magnetic material, the second magnetizing array ring cooperating with the magnetizing array ring to adjust the directions and increase a flux density at selective portions of the ring of bulk magnetic material to modify grain alignment.

15. The magnetic array assembly of claim 14, wherein the first magnetizing array ring, the second magnetizing array ring, or both have a circumferentially varying radial thickness or height to adjust the directions.

16. The magnetic array assembly of claim 15, wherein one of the magnetizing array rings is a soft magnetic material.

17. The magnetic array assembly of claim 14, wherein the bulk magnetic material is MnBi.

18. The magnetic array assembly of claim 14, wherein the bulk magnetic material includes Ti, Zr, Nb, or Ta, or combinations thereof.

19. The magnetic array assembly of claim 13, wherein the annular structure of magnetizing material generates the continuous magnetic field where the directions gradually change about a circumference of the annular structure.

* * * * *